US007523628B2

(12) United States Patent
Yu

(10) Patent No.: US 7,523,628 B2
(45) Date of Patent: Apr. 28, 2009

(54) DUAL-LOCKING DEVICE

(76) Inventor: Chun Te Yu, No. 253, Sec. 3, Yanhai Rd., Fusing Township, Changhua County 506 (TW)

( * ) Notice: Subject to any disclaimer, the term of this patent is extended or adjusted under 35 U.S.C. 154(b) by 0 days.

(21) Appl. No.: 11/806,695

(22) Filed: Jun. 4, 2007

(65) Prior Publication Data

US 2008/0196459 A1 Aug. 21, 2008

(30) Foreign Application Priority Data

Feb. 16, 2007 (TW) ..... 96106259 A

(51) Int. Cl.
*E05B 37/02* (2006.01)

(52) U.S. Cl. ..... 70/21; 70/25; 70/38 C; 70/284; 70/285; 70/360

(58) Field of Classification Search ..... 70/21, 70/22, 25, 26, 38 A, 38 C, 284, 285, 432–441, 70/DIG. 63, DIG. 71, 38 R, 38 B, 39, 49, 70/53, 360, 361, 387
See application file for complete search history.

(56) References Cited

U.S. PATENT DOCUMENTS

| | | | | | |
|---|---|---|---|---|---|
| 361,294 | A * | 4/1887 | Jillson | 70/437 |
| 526,740 | A * | 10/1894 | Rapaport | 70/25 |
| 686,882 | A * | 11/1901 | Ballou | 70/38 C |
| 972,171 | A * | 10/1910 | Dupont | 70/21 |
| 983,637 | A * | 2/1911 | Murphy | 70/38 R |
| 1,052,627 | A * | 2/1913 | Takimoto | 70/21 |
| 1,300,793 | A * | 4/1919 | Waterfield | 70/25 |
| 1,308,458 | A * | 7/1919 | Voight | 70/437 |
| 1,390,222 | A * | 9/1921 | Wise | 70/38 C |
| 1,597,560 | A * | 8/1926 | Wise | 70/38 R |
| 1,755,521 | A * | 4/1930 | Smith | 70/21 |
| 1,840,469 | A * | 1/1932 | Sabo | 70/38 A |
| 1,928,215 | A * | 9/1933 | Steffen | 70/38 C |
| 3,789,639 | A * | 2/1974 | Canter | 70/437 |
| 3,808,848 | A * | 5/1974 | Yang | 70/21 |
| 3,823,584 | A * | 7/1974 | Gill | 70/21 |
| 4,751,830 | A * | 6/1988 | Cheng | 70/25 |
| 6,539,761 | B2 * | 4/2003 | Yang | 70/284 |
| 6,615,626 | B2 * | 9/2003 | Yu et al. | 70/301 |
| 6,877,345 | B1 * | 4/2005 | Misner et al. | 70/25 |
| 6,928,842 | B1 * | 8/2005 | Huang | 70/21 |
| 7,117,698 | B2 * | 10/2006 | Lai | 70/21 |
| 2002/0088256 | A1 * | 7/2002 | Taylor et al. | 70/25 |
| 2007/0204664 | A1 * | 9/2007 | Tang | 70/38 A |
| 2007/0227202 | A1 * | 10/2007 | Yen et al. | 70/21 |

* cited by examiner

*Primary Examiner*—Lloyd A Gall
(74) *Attorney, Agent, or Firm*—Rosenberg, Klein & Lee

(57) ABSTRACT

A dual-locking device includes a housing, a shackle and a combination locking mechanism and a key-operated locking mechanism. The shackle is movably mounted on the housing. The shackle comprises a controlling portion, a hook portion, and a root portion. The controlling portion is located inside the housing. The hook portion extends outside the housing from one end of the controlling portion. The root portion extends inside the housing from the other end of the controlling portion. The combination locking mechanism is disposed in the housing and capable of controlling movement of the controlling portion by entering a code. The key-operated locking mechanism is disposed in the housing and capable of controlling movement of the root portion by a key.

13 Claims, 9 Drawing Sheets

DUAL-LOCKING DEVICE

BACKGROUND OF INVENTION

1. Field of Invention

The present invention relates to a lock and in particular to a dual-locking device which can be unlocked by either a key or a combination.

2. Related Prior Art

Taiwan Patent No. M247654 discloses a conventional dual-locking device which includes a housing, a shackle, a combination locking mechanism and a key-operated locking mechanism. The shackle includes a hook portion and a root portion. The two locking mechanisms control the hook portion and the root portion of the shackle respectively. However, the two locking mechanisms are located side by side so that the conventional dual-locking device is wide. In addition, the key-locking mechanism needs to drive a driven member to cooperate with the hook portion of the shackle for locking and unlocking. Thus, the structure is more complicated.

U.S. Pat. No. 6,877,345 discloses another dual-locking device. The dual-locking device controls a hook portion of a shackle by a combination locking mechanism directly and controls indirectly the hook portion of the shackle by a key-operated locking mechanism. Since the two locking mechanisms are side by side, the dual-locking device is still wide. Furthermore, the key-operated locking mechanism needs to drive a member to control whether sleeves can move. That is, the key-operated locking mechanism controls whether the shackle can be released indirectly. Therefore, the structure is complicated.

SUMMARY OF INVENTION

The primary object of this invention is therefore to provide a simple dual-locking device which can be unlocked by either a key or a combination. In addition, the dual dual-locking device can be narrower.

According to the present invention, the dual-locking device comprises a housing, a shackle, a combination locking mechanism and a key-operated locking mechanism. The shackle is movably mounted on the housing. The shackle includes a controlling portion, a hook portion, and a root portion. The controlling portion is disposed in the housing. The hook portion extends outside the housing from one end of the controlling portion. The root portion extends inside the housing from the other end of the controlling portion. The combination locking mechanism is disposed in the housing and is capable of controlling movement of the controlling portion of the shackle by entering a code. The key-operated locking mechanism is disposed in the housing and is capable of controlling movement of the root portion of the shackle by a specific key. In such a manner, both the two locking mechanisms can control locking and unlocking the dual-locking device and thereby the structure is quite simple. In addition, the two locking mechanisms can be aligned in a line coaxially with the controlling portion so as to reduce the width of the dual-locking device. Alternatively, the housing can further define a room for installing other functional units, such as an identification member illustrated below.

Preferably, the dual-locking device further includes the identification member. The housing defines a window. The identification member includes a rod and a knob. The rod is rotatably disposed in the housing and has at least one face visible through the window. The knob is located outside of the housing for being driven to rotate the rod. In such a manner, personal information or the like can be posted or printed on a side of the rod. When the rod is rotated by the knob, the personal information can then be seen and identified through the window.

Further benefits and advantages of the present invention will become clear as the description proceeds.

BRIEF DESCRIPTION OF DRAWINGS

The invention will now be elucidated with reference to the following description and accompanying drawings where.

DETAILED DESCRIPTION OF PREFERRED EMBODIMENT

Figure 1:
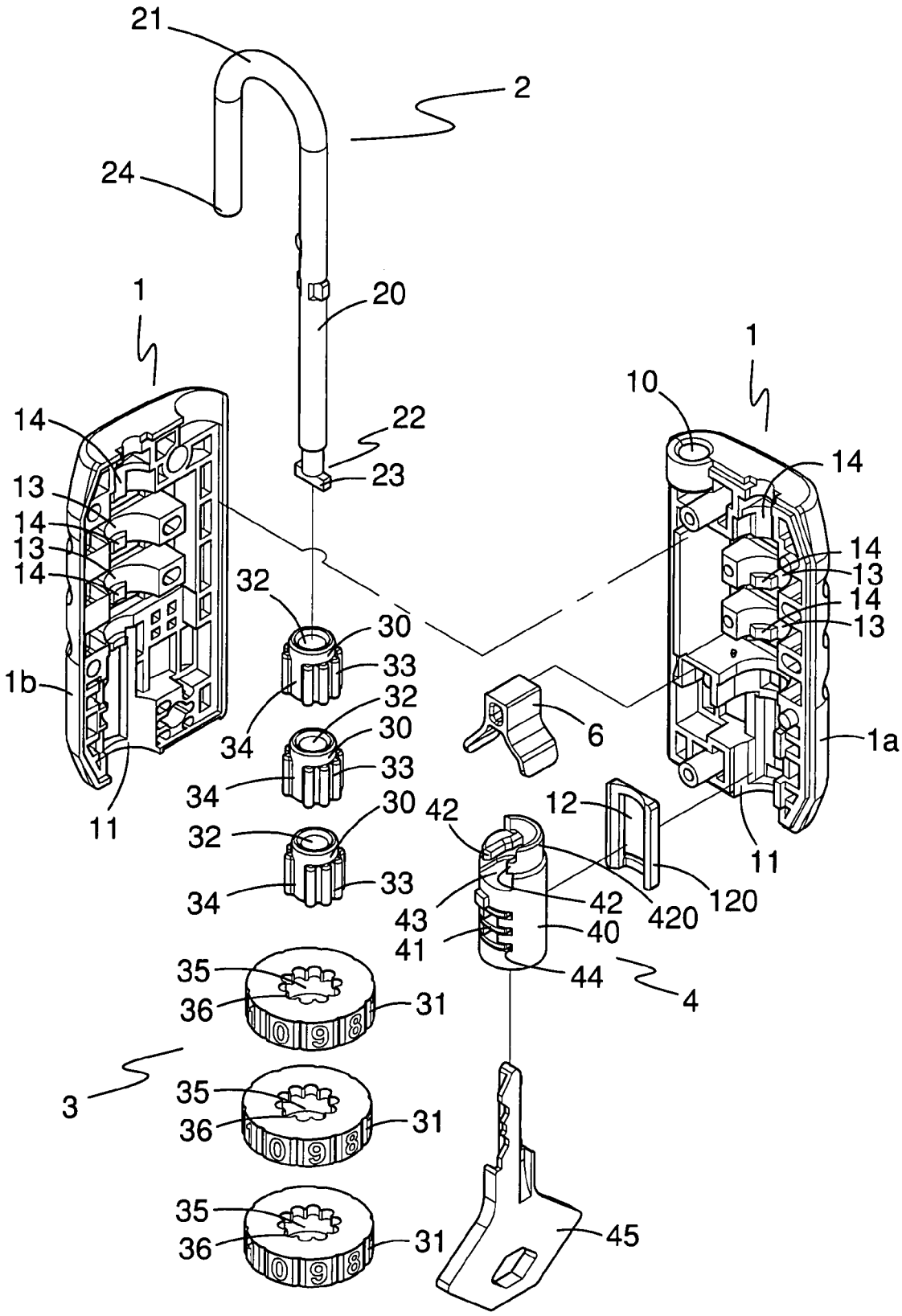
FIG. 1 is an exploded view of a dual-locking device according to a first embodiment of the present invention.

FIG. 1 is a dual-locking device according to a first embodiment of the present invention. The dual-locking device comprises a housing 1, a shackle 2, a combination locking mechanism 3, a key-operated locking mechanism 4 and a resilient member 6.

The housing 1 has opposed front and rear shells 1*a*, 1*b*. The housing 1 defines an aperture 10, a first chamber 11 and a plurality of second chambers 13 therein and is formed with six bulges 14. The aperture 10 is defined in a top of the housing 1. The first chamber 11 is defined inside of the housing 1 for receiving the key-operated locking mechanism 4. The second chambers are defined in the housing 1. On the opposed shells 1*a*, 1*b* are the six bulges 14, three as a group, spaced at intervals corresponding to the second chambers 13. The housing 1 further includes a stop member 120 disposed in the first chamber 11. The stop member 120 defines a notch 12 therein.

The shackle 2 is movably mounted on the housing 1 and comprises a controlling portion 20, a hook portion 21 and a root portion 22. The controlling portion 20 can move axially in the housing 1. The hook portion 21 extends from one end of the controlling portion 20. The hook portion 21 has an end 24 which can move with the controlling portion 20 to be lodged in or removed from the aperture 10. The root portion 22 extends from the other end of the controlling member 20 and is formed with a block 23 therebottom.

The combination locking mechanism 3 located in the housing 1 comprises three inner wheels 30 and three outer wheels 31. The inner wheels 30 can move axially in the second chambers 13. Each of the inner wheels 30 defines a through hole 32. The through holes 32 of the inner wheels co-define a channel for receiving the controlling portion 20 of the shackle 2. Each of the inner wheels 30 has teeth 33 around. The inner wheel 30 defines two trenches 34 at two opposite sides thereof wherein each of the trenches 34 is defined between two adjacent teeth 33. The trench 34 has the same width as the bulge 14. Each of the outer wheels 31 defines a through hole 35 therein for receiving a respective one of the inner wheels 30. The through hole 35 of the outer wheel 31 includes a plurality of recesses 36 spaced at intervals in an inner wall which encircles the through hole 35 for receiving the teeth 33 of the inner wheel 30. When numbers of the outer wheels 31 are arranged in a wrong combination, the trenches 34 of the inner wheels 30 and the bulges 14 of the housing 1 are staggered so that the teeth 33 are retained by the bulges 14. Thus, the inner wheels 30 are not allowed to move axially within the second chambers 13. When the numbers of the outer wheels 31 are arranged in a right combination, the trenches 34 and the bulges 14 are aligned so that the inner wheels 30 are allowed to move axially within the second chambers 13.

The key-operated locking mechanism 4 comprises a cylinder 40, a plurality of latching pieces 41 and a plurality of springs (not shown). The cylinder 40 is located in the housing 1 and coaxial with the root portion 22 of the shackle 2. The cylinder 40 comprises two fastening portions 42, a cavity 43, a supporting portion 420 and a plurality of slots 44. The cavity 43 is provided for receiving the block 23 of the root portion 22 of the shackle 2. The fastening portion 42 is located above the cavity 43 for seizing the block 23. In this manner, the cylinder 40 can be driven by the shackle 2 to move axially in the first chamber 11. The supporting portion 420, at a top of the cylinder 40, can abut against a bottom of the lowest inner wheel 30. The slots 44 receive the latching pieces 41 respectively. Each of the latching pieces 41 has an end confined in the notch 12 of the housing 1. The latching pieces 41 can move with the cylinder 40 in the notch 12. In addition, the latching pieces 41 can be released from the notch 12 by inserting a specific key 45 into the cylinder 40 so that the cylinder 40 can be rotated by further rotating the key 45. The springs are disposed in the slots 44 respectively. When the key 45 is drawn out from the cylinder 40, the springs push the latching pieces 41 back to their original positions, and thereby the ends of the latching pieces 41 are lodged in the notch 12 again.

The resilient member 6 is disposed in the housing 1. The resilient member 6 abuts against a side of the cylinder 40 to position the cylinder 40.

In the first embodiment, the controlling portion 20, the hook portion 21 and the root portion 22 compose the shackle 2. In other example, instead of the hook portion 21, a cable or the like can be connected to the controlling portion 20 to form a cable lock or the like.

In the first embodiment, the housing 1 is made of plastic materials. The stop member 120 defining the notch 12 is preferably made of iron in case the stop member suffers a lot of wear and tear as a result of the iron-made key-operated locking mechanism 4. However, if the housing 1 is made of iron or other rigid materials, the notch 12 can be directly defined in an inner wall of the housing 1 which defines the first chamber 11. This kind of structure can be seen more clearly in the following description.

Figure 2:
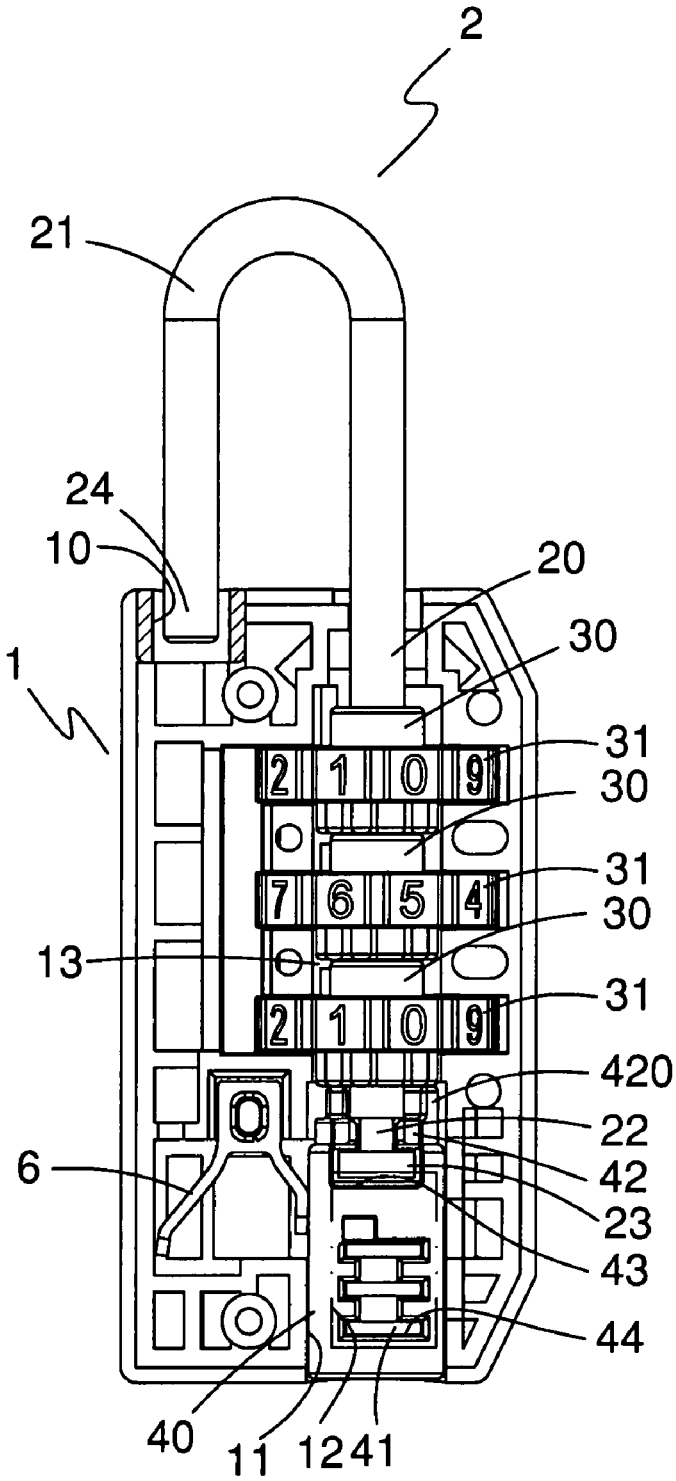
FIG. 2 is a cross-sectional view of the dual-locking device of FIG. 1.

Referring to FIG. 2, the numbers of the three outer wheels 31 are arranged in a wrong combination and the cylinder 40 is not yet inserted by the key 45. In this state, the inner wheels 30 can not move axially in the second chambers 13. Thus, the supporting portion 420 is retained by the inner wheels 30 so that the cylinder 40 can not move axially. The controlling portion 20 can neither move axially as a result of the root portion 22 unable to pull the cylinder 40. Thus, the shackle 2 is in a locked position where an end 24 of the hook portion 21 is restricted in the aperture 10 of the housing 1.

Figure 3:
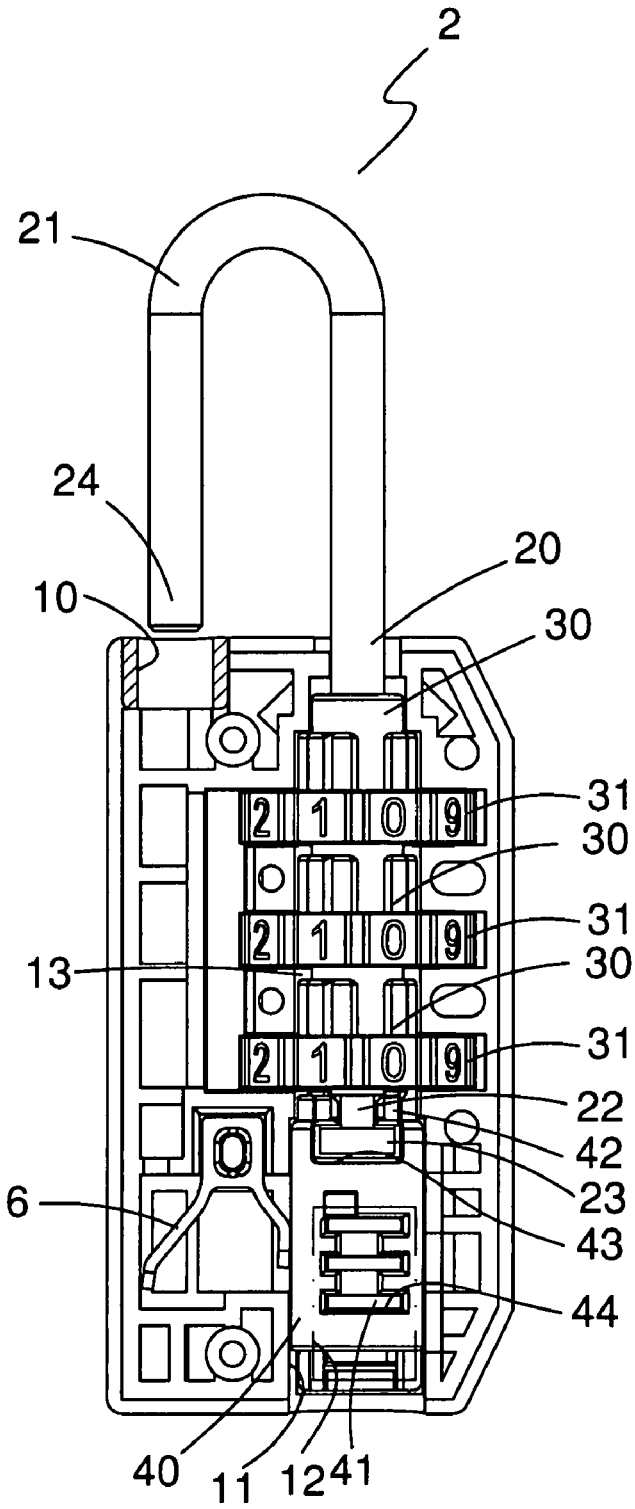
FIG. 3 shows the dual-locking device of FIG. 1 unlocked by entering a code.

Referring to FIG. 3, the numbers of the three outer wheels 31 are arranged in the right combination and the cylinder 40 is not yet driven by the key 45. In this state, the inner wheels 30 can move axially in the second chambers 13. So, the root portion 22 of the shackle 2 can drive the cylinder 40 to move the inner wheels 30 axially. Thus, the controlling portion 20 can move axially as a result of the root portion 22 capable of pulling the cylinder 40. Thus, the shackle 2 is allowed to move to an unlocked position where the end 24 of the hook portion 21 is released from the aperture 10 of the housing 1.

Figure 4:
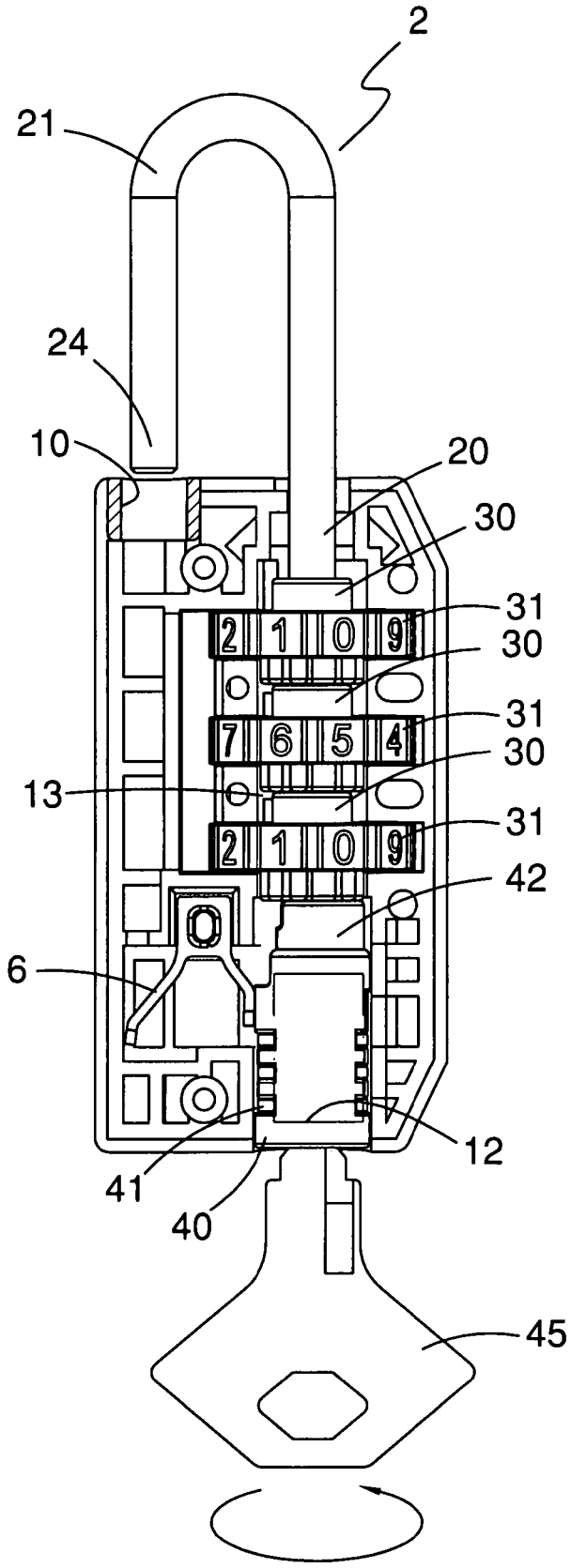
FIG. 4 shows the dual-locking device of FIG. 1 unlocked by a key.

Referring to FIG. 4, the numbers of the three outer wheels 31 are arranged in the wrong combination and the cylinder 40 is inserted and rotated 90 degrees by the key 45. In this state, the inner wheels 30 can not move axially in the second chambers 13. However, the fastening portion 42 of the cylinder 40 releases the block 23 of the root portion 22 of the shackle 2 so that the root portion 22 of the shackle 2 can move axially. So, the controlling portion 20 can move axially in the channel defined by the inner wheels 30. Thus, the controlling portion 20 can move axially as a result of the root portion 22 capable of pulling out the cylinder 40. Thus, the shackle 2 is in the unlocked position where the end 24 of the hook portion 21 is released from the aperture 10 of the housing 1.

Figure 11:
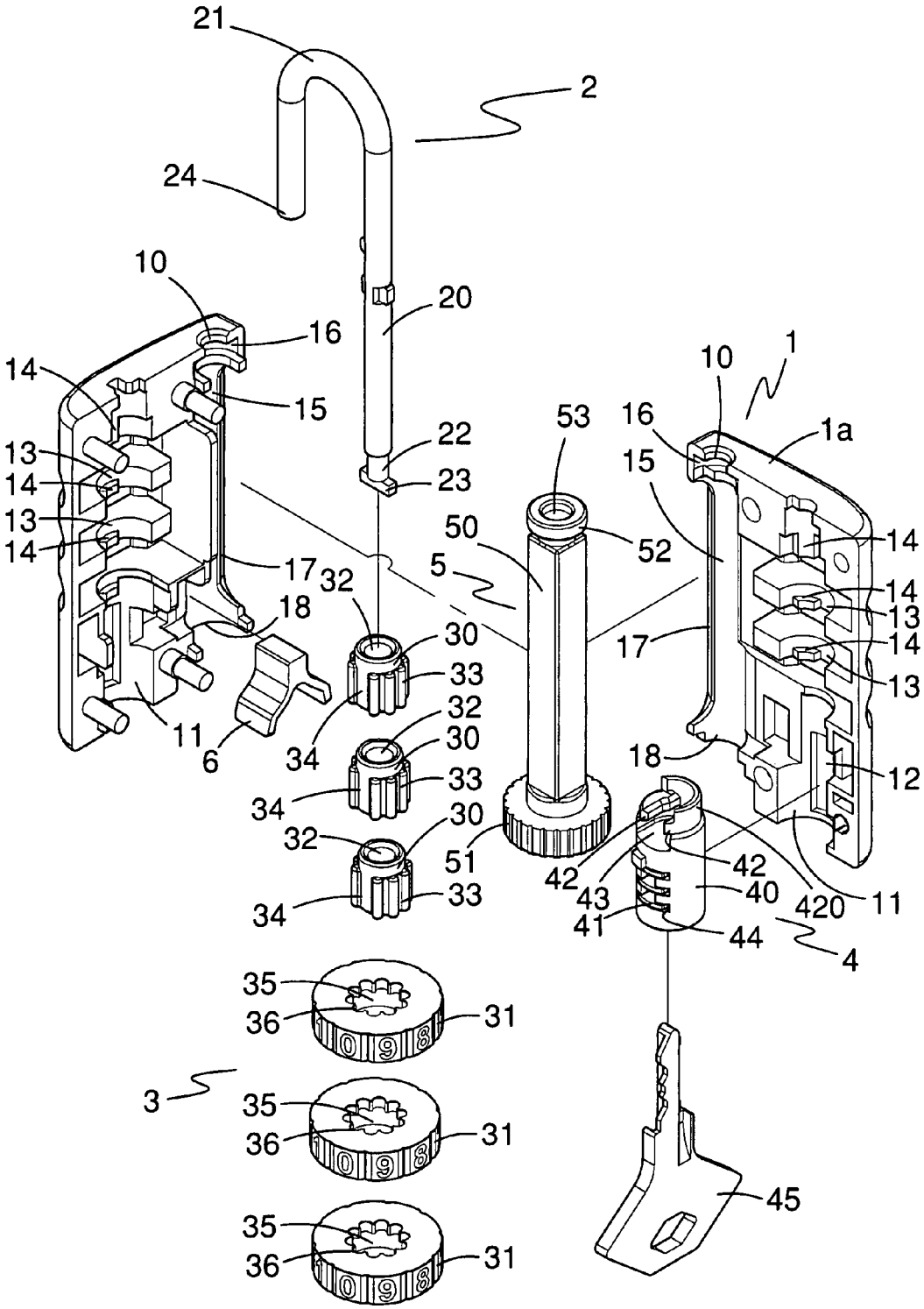
FIG. 11 is an exploded view of a dual-locking device according to a third embodiment of the present invention.
Figure 12:
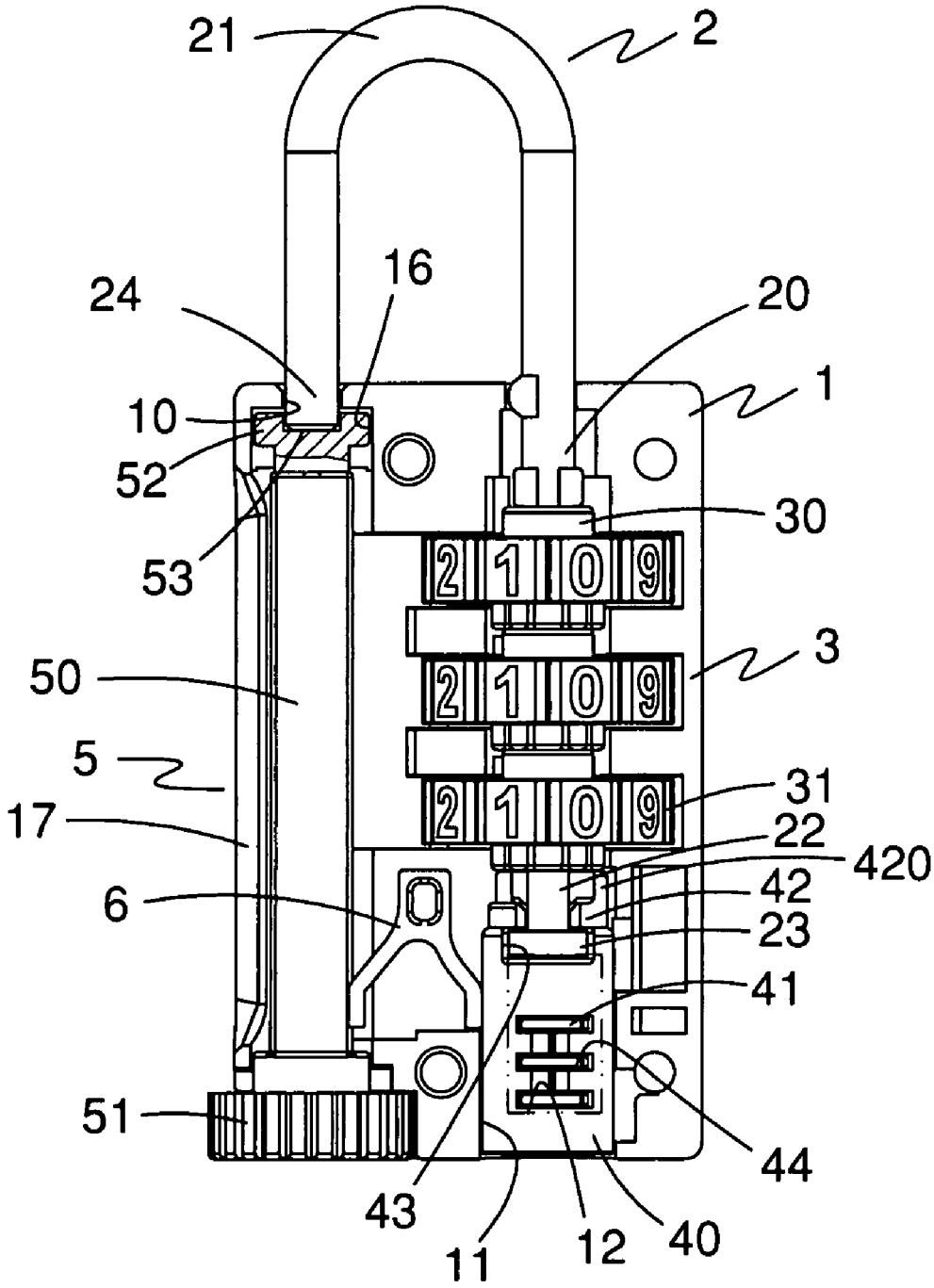
FIG. 12 is a cross-sectional view of the dual-locking device of FIG. 11.

Since both the combination locking mechanism 3 and the key-operated locking mechanism 4 can control the controlling portion 20 directly so as to lock or unlock the dual-locking device, the structure is quite simple. The combination locking mechanism 3 and the key-operated locking mechanism 4 can lie in a line coaxial with the controlling portion 20 so as to cut down the width of the dual-locking device. Or, the housing 1 may have an unoccupied room which can be installed with other functional units, as shown in FIGS. 11 and 12.

Figures 5, 6:
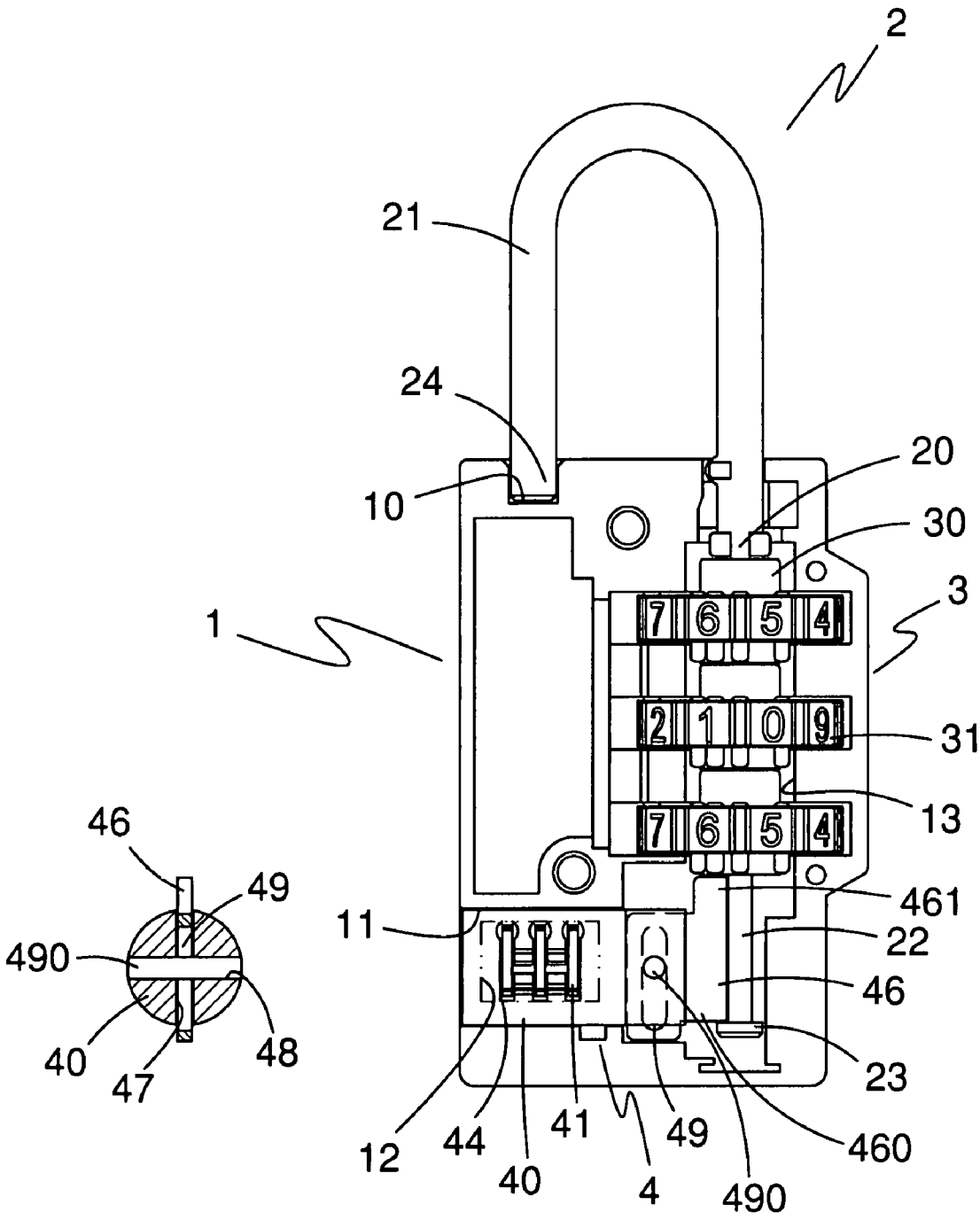
FIG. 5 is a cross-sectional view of a dual-locking device according to a second embodiment of the present invention.
FIG. 6 shows a cylinder and a locking member illustrated in FIG. 5.

Referring now to FIGS. 5 and 6, a second embodiment of dual-locking device is shown similar with the first embodiment except that:

When the cylinder 40 of the key-operated locking mechanism 4 is received in the first chamber 11, the cylinder 40 and the root portion 22 of the shackle 2 are perpendicular to one another. Furthermore, the cylinder 40 can not move axially but rotate in the first chamber 11.

The key-operated locking mechanism 4 further comprises a locking member 46. The cylinder 40 defines a passage 47 in an end thereof. The cylinder 40 further defines a hole 48 crossed through the passage 47. The locking member 46 is movably disposed in the passage 47. The locking member 46 defines a slit 49 therethrough. A bolt 490 is provided to pass through the hole 48 and the slit 49 so as to attach the locking member 46 to the cylinder 40. The locking member 46 can move in a line within the passage 47 of the cylinder 40. The locking member 46 includes a fastening portion 460 and a supporting portion 461. The fastening portion 460 blocks a top of the block 23 of the root portion 22 of the shackle 2. The supporting portion 461 abuts against a bottom of the lowest inner wheel 30. When the cylinder 40 is rotated by the key 45, the locking member 46 can be driven to rotate an angle so as to release the block 23.

Referring to FIGS. 5 and 6, the numbers of the three outer wheels 31 are arranged in a wrong combination and the cylinder 40 is not yet driven by the key 45. In this state, the inner wheels 30 can not move axially in the second chambers 13. The locking member 46 is retained by the inner wheels 30 so that the block 23 of the root portion 22 of the shackle 2 is not allowed to move axially. Thus, the shackle 2 is in a locked position where the end 24 of the hook portion 21 is restricted in the aperture 10 of the housing 1.

Figures 7, 8:
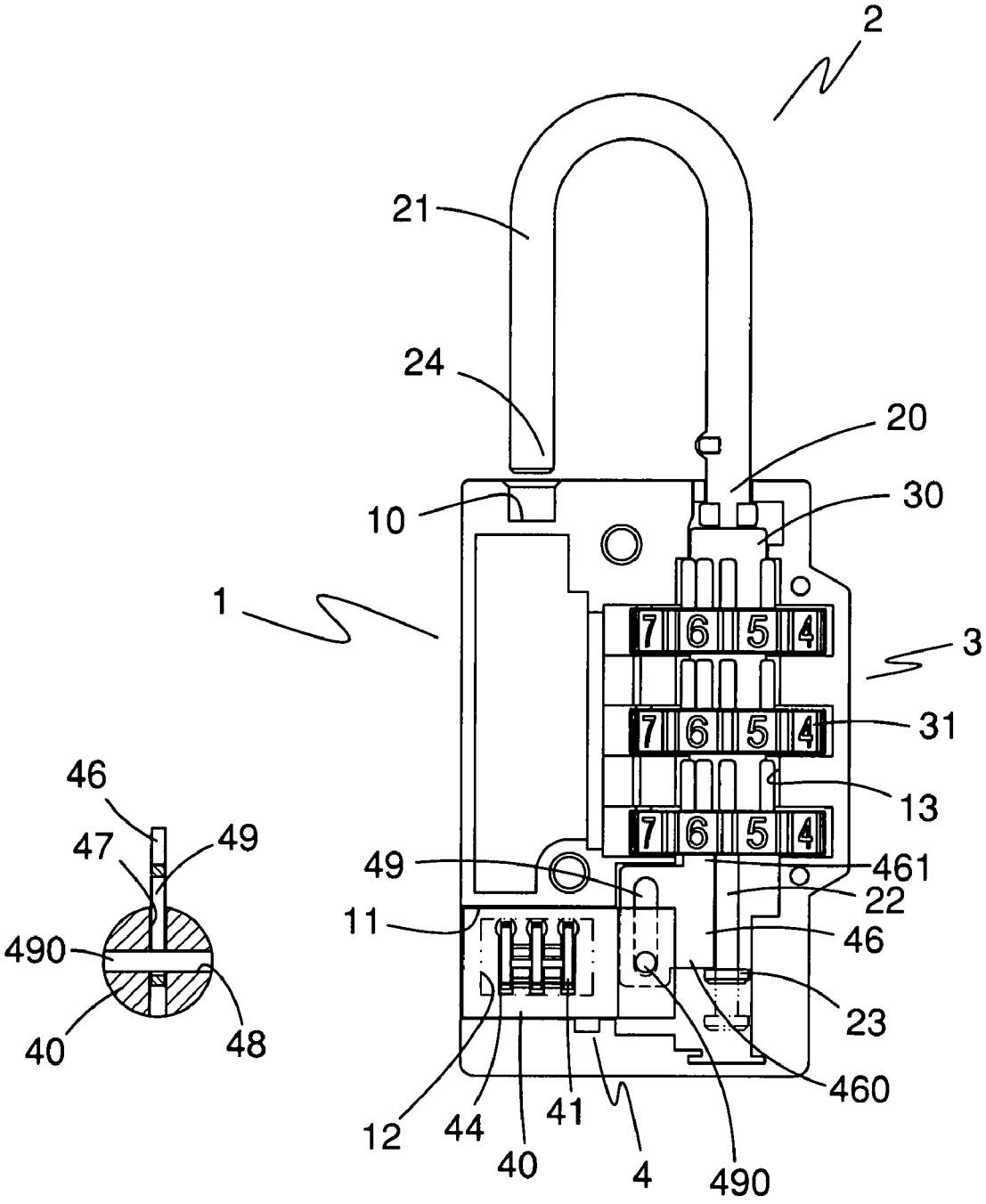
FIG. 7 shows the dual-locking device of FIG. 5 unlocked by entering a code.
FIG. 8 shows the cylinder and the locking member illustrated in FIG. 7.

Referring to FIGS. 7 and 8, the numbers of the three outer wheels 31 are arranged in a right combination and the cylinder 40 is not yet driven by the key 45. In this state, the inner wheels 30 can move axially in the second chambers 13. So, the block 23 of the root portion 22 can drive the locking member 46 to move so that the inner wheels 30 can move axially. Thus, the shackle 2 is allowed to move to an unlocked position where the end 24 of the hook portion 21 is released from the aperture 10 of the housing 1.

Figures 9, 10:
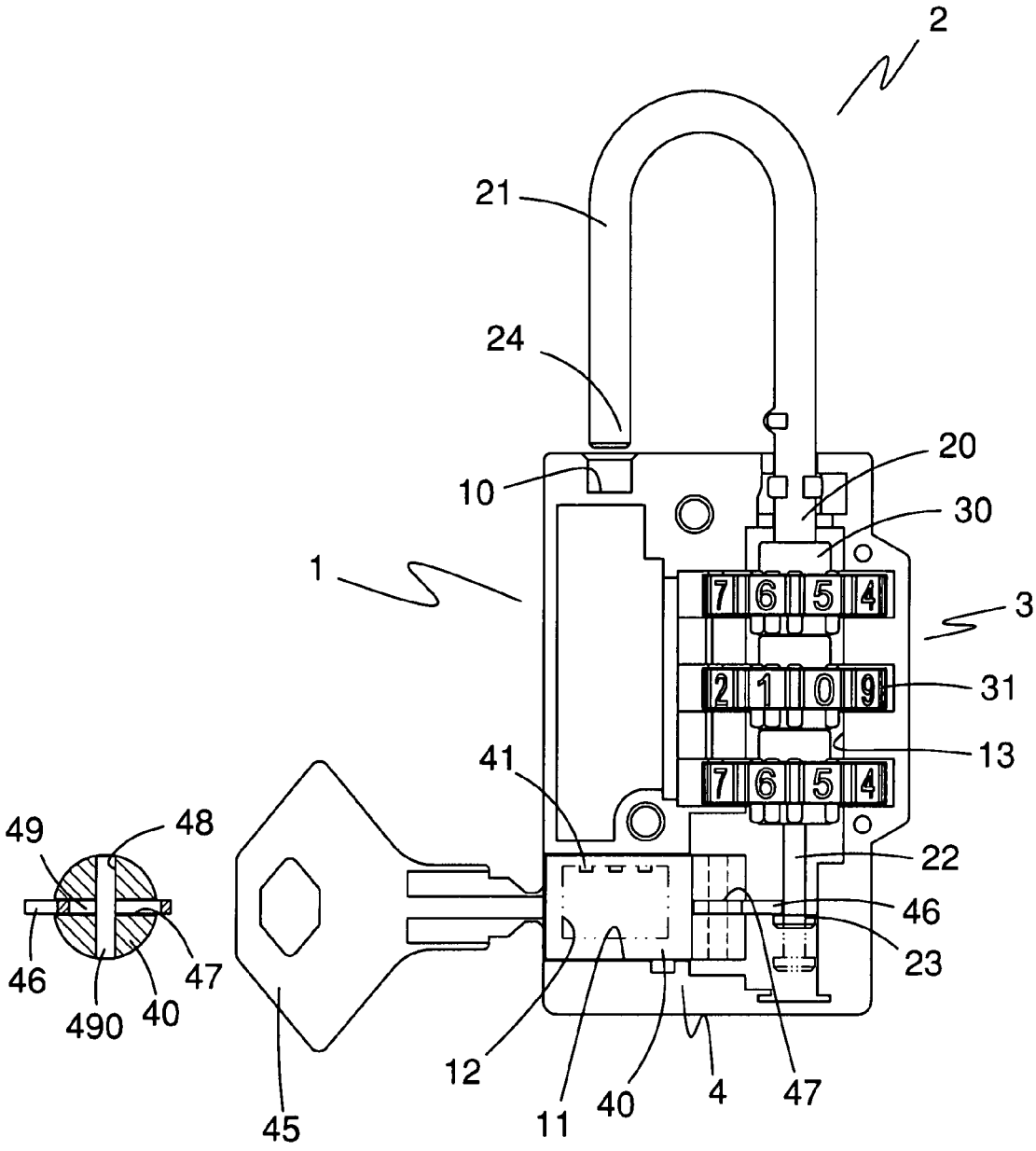
FIG. 9 shows the dual-locking device of FIG. 5 unlocked by a key.
FIG. 10 shows the cylinder and the locking member illustrated in FIG. 9.

Referring to FIGS. 9 and 10, the numbers of the three outer wheels 31 are arranged in the wrong combination and the cylinder 40 is driven to rotate 90 degrees by the key 45. In this state, the inner wheels 30 can not move axially in the second chambers 13. The locking member 46 releases the block 23 of the root portion 22 of the shackle 2 to allow the root portion 22 move axially. In the meanwhile, the controlling portion 20 can move axially in the channel defined by the inner wheels 30. Thus, the shackle 2 is allowed to move to the unlocked position where the end 24 of the hook portion 21 is released from the aperture 10 of the housing 1.

Referring to FIGS. 11 and 12, a third embodiment of dual-locking device is shown similar with the first embodiment except that the third embodiment further comprises an identification member 5, wherein:

The housing 1 further defines a room 15, a compartment 16, a window 17 and an opening 18 therein. The room 15 and the compartment 16 are defined inside the housing 1. The compartment 16 is in communication with the room 15 and the aperture 10. The window 17 and the opening 18 are defined in two adjacent sides of the housing 1 respectively. Also, the window 17 and the opening 18 are in communication with the room 15 respectively.

The identification member 5 includes a rod 50, a knob 51 and a joint 52. The rod 50 is disposed in the room 15 and has at least one face visible through the window 17. The knob 51 is attached to a bottom of the rod 50 and exposed to the outside of the opening 18 for driving the rod to 50 rotate. The joint 52 is connected with a top of the rod 50. The joint 52 is rotatably lodged in the compartment 16 so that the rod 50 can not be pulled out from the opening 18. Furthermore, the joint 52 has a recess 53 for receiving the end 24 of the hook portion 21. It is noted that the rod 50 could be rectangular, cylindrical, or polyhedral. Personal information can be posted or printed on the face of the rod 50. The resilient member 6 abuts against a side of the rod 50 for positioning the rod 50. Therefore, the personal information can be seen and identified via the window 17 by operating the knob 51 to rotate the rod 50.

Numerous characteristics and advantages of the invention have been set forth in the foregoing description. The disclosure, however, is illustrative only, and changes may be made in detail within the principle of the invention, to the full extent indicated by the broad general meaning of the terms in which the appended claims are expressed.

The invention claimed is:

1. A dual-locking device comprising:

a housing;

a shackle movably mounted on the housing and comprising a controlling portion disposed in the housing, a hook portion extending outside the housing from an end of the controlling portion, and a root portion extending inside the housing from another end of the controlling portion;

a combination locking mechanism disposed in the housing and including a plurality of inner wheels disposed about the controlling portion and a plurality of outer wheels disposed about the inner wheels respectively wherein the combination locking mechanism is capable of controlling movement of the controlling portion by entering a code; and a key-operated locking mechanism disposed in the housing and capable of controlling movement of the root portion by a key, wherein the key-operated locking mechanism connects with the root portion of the shackle and moves with the root portion in the same direction.

2. The dual-locking device of claim 1 wherein:

the housing defines a first chamber therein;

the root portion of the shackle has a block;

the key-operated locking mechanism comprises a cylinder coaxial with the root portion of the shackle;

the cylinder can move axially in the first chamber and includes at least one fastening portion and a cavity therein;

the cavity is provided for receiving the block of the root portion; and the fastening portion can fasten the block, and the fastening portion can release the block when the cylinder is rotated by the key.

3. The dual-locking device of claim 2 wherein the cylinder further includes a supporting portion abutting against the inner wheels so as to limit movement of the cylinder.

4. The dual-locking device of claim 1 wherein:

the housing defines a first chamber therein;

the root portion of the shackle includes a block;

the key-operated locking mechanism comprises a cylinder and a locking member;

the cylinder is received in the first chamber;

the locking member is movably connected with the cylinder and includes a fastening portion and a supporting portion;

the fastening portion can limit movement of the block;

the supporting portion can abut against the inner wheels so as to limit movement of the locking member; and the cylinder can be rotated by the key to release the block from the fastening portion.

5. The dual-locking device of claim 2 wherein:

the housing includes a notch defined in an inner wall of the first chamber;

the key-operated locking mechanism includes a plurality of latching pieces;

the cylinder defines a plurality of slots for receiving the latching pieces respectively;

each of the latching pieces has an end lodged in the notch and can move with the cylinder within the notch; and when the key is inserted in the cylinder, the latching pieces depart from the notch to enable the cylinder to rotate.

6. The dual-locking device of claim 4 wherein:

the housing includes a notch defined in an inner wall of the first chamber;

the key-operated locking mechanism includes a plurality of latching pieces;

the cylinder defines a plurality of slots for receiving the latching pieces respectively;

each of the latching pieces has an end lodged in the notch and can move with the cylinder within the notch; and when the key is inserted in the cylinder, the latching pieces depart from the notch to enable the cylinder to rotate.

7. The dual-locking device of claim 1 wherein:

the housing defines a plurality of chambers for correspondingly receiving the inner wheels;

the housing is formed with bulges on walls of the chambers corresponding to the inner wheels;

each of the inner wheels has a plurality of teeth at a periphery thereof and has at least one trench defined between two adjacent teeth;

the trench has a width same as the bulge;

each of the outer wheels defines a through hole therein for receiving a respective one of the inner wheels;

the through hole includes a plurality of recesses spaced at intervals in an inner wall of the through hole for receiving the teeth of the inner wheel;

when numbers of the outer wheels are arranged in a wrong combination, the trenches of the inner wheels and the bulges of the housing are staggered such that the inner wheels are not allowed to move axially within the chambers; and when the numbers of the outer wheels are arranged in a right combination, the trenches of the inner wheels and the bulges of the housing are aligned such that the inner wheels are allowed to move axially within the chambers.

8. The dual-locking device of claim 2 wherein:

the housing defines a plurality of second chambers for correspondingly receiving the inner wheels;

the housing is formed with bulges on walls of the second chambers corresponding to the inner wheels;

each of the inner wheels has a plurality of teeth at a periphery thereof and has at least one trench defined between two adjacent teeth;

the trench has a width same as the bulge;

each of the outer wheels defines a through hole therein for receiving a respective one of the inner wheels;

the through hole includes a plurality of recesses spaced at intervals in an inner wall of the through hole for receiving the teeth of the inner wheel;

when numbers of the outer wheels are arranged in a wrong combination, the trenches of the inner wheels and the bulges of the housing are staggered such that the inner wheels are not allowed to move axially within the second chambers; and when the numbers of the outer wheels are arranged in a right combination, the trenches of the inner wheels and the bulges of the housing are aligned such that the inner wheels are allowed to move axially within the second chambers.

9. The dual-locking device of claim 1 further comprising an identification member; the housing defining a room, a window and an opening therein; the room being defined in the housing; the window and the opening being in communication with the room; the identification member including a rod and a knob; the rod being capable of rotating within the room; the rod having at least one face visible through the window; and the knob being connected with an end of the rod and exposed outside of the opening for driving the rod to rotate.

10. The dual-locking device of claim 9 further comprising a resilient member disposed in the housing; and the resilient member abutting against a side of the rod to position the rod.

11. A dual-locking device comprising:

a housing defining a room, a window and an opening therein; the room being defined in the housing; the window and the opening being in communication with the room;

a shackle movably mounted on the housing and comprising a controlling portion disposed in the housing, a hook portion extending outside the housing from an end of the controlling portion, and a root portion extending inside the housing from another end of the controlling portion;

a combination locking mechanism disposed in the housing and capable of controlling movement of the controlling portion by entering a code;

a key-operated locking mechanism disposed in the housing and capable of controlling movement of the root portion by a key; and an identification member including a rod and a knob; the rod being capable of rotating within the room; the rod having at least one face visible through the window; and the knob being connected with an end of the rod and exposed outside of the opening for driving the rod to rotate.

12. The dual-locking device of claim 11 further comprising a resilient member disposed in the housing; and the resilient member abutting against a side of the rod to position the rod.

13. A dual-locking device comprising:

a housing;

a shackle movably mounted on the housing and including a root portion extending inside the housing;

a key-operated locking mechanism disposed in the housing and capable of controlling movement of the root portion by a key, wherein the key-operated locking mechanism connects with the root portion and moves with the root portion in the same direction; and a combination locking mechanism disposed in the housing, wherein the shackle further includes a controlling portion disposed in the housing and a hook portion extending outside the housing; the controlling portion is connected at one end to the root portion and at the other end to the hook portion; and the combination locking mechanism defines a channel for receiving the controlling portion and is capable of controlling movement of the controlling portion by entering a code.

* * * * *